US007173199B2

(12) United States Patent
Lu et al.

(10) Patent No.: US 7,173,199 B2
(45) Date of Patent: Feb. 6, 2007

(54) SWITCHING SIGNAL INPUT DEVICE FOR USE WITH ELECTRONIC APPARATUS

(76) Inventors: Chang Kun Lu, No. 669, Ruey Kuang Road, Neihu, Taipei (TW) 114; Wen Shin Wang, No. 669, Ruey Kuang Road, Neihu, Taipei (TW) 114

( * ) Notice: Subject to any disclaimer, the term of this patent is extended or adjusted under 35 U.S.C. 154(b) by 132 days.

(21) Appl. No.: 11/075,713

(22) Filed: Mar. 10, 2005

(65) Prior Publication Data

US 2006/0151305 A1 Jul. 13, 2006

(30) Foreign Application Priority Data

Jan. 7, 2005 (TW) ..... 94100430 A

(51) Int. Cl.
*H01H 13/70* (2006.01)
*H01H 13/702* (2006.01)
*H01H 1/12* (2006.01)

(52) U.S. Cl. ..... 200/1 R; 200/5 A; 200/5 R; 200/17 R; 200/329

(58) Field of Classification Search ..... 200/1 R
See application file for complete search history.

(56) References Cited

U.S. PATENT DOCUMENTS 6,344,620 B1 * 2/2002 Nakamura ..... 200/6 A
6,670,893 B1 * 12/2003 Svarfvar ..... 341/22
6,744,890 B1 * 6/2004 Le et al. ..... 379/433.07
6,953,900 B2 * 10/2005 Sottong ..... 200/5 R

* cited by examiner

*Primary Examiner*—Elvin Enad
*Assistant Examiner*—Lheiren Mae A. Anglo
(74) *Attorney, Agent, or Firm*—Berkeley Law & Technology Group LLC

(57) ABSTRACT

A switching signal input device for use with an electronic apparatus is provided. The switching signal input device includes a switch part, an operating part and a resilience element, and is capable of performing four-directional switch control actions in response to the elastic forces generated from the resilience element on two planes perpendicular to each other.

4 Claims, 3 Drawing Sheets

SWITCHING SIGNAL INPUT DEVICE FOR USE WITH ELECTRONIC APPARATUS

FIELD OF THE INVENTION

The present invention relates to a switching signal input device, and more particularly to a switching signal input device for use with an electronic apparatus.

BACKGROUND OF THE INVENTION

Generally, electronic apparatuses such as MP3 players, subscriber identity module (SIM) card readers and the like have user operation interfaces for users to control for example volume or function selection of the electronic apparatuses. These electronic apparatuses are usually controlled in response to switching signals. The user operation interfaces of the touch switches, for example touch pads, knobs and the like, are usually mounted on the electronic apparatuses. In other words, by controlling these user operation interfaces, the touch switches will be triggered to generate switching signals.

Conventionally, the switch operation interface is a disc-shaped touch pad having several (for example four) touch points. Each touch point correlates to a switch. In response to a depressing operation, the corresponding switch is triggered to generate a switching signal. This approach, however, has some drawbacks. For example, the touch pad occupies much area. In addition, some users may have problem in operating the touch pad to control the electronic apparatus.

Another switch operation interface having rotary means is convenient for other users. Such a switch operation interface has a rotatable control rod rotated to trigger the switch. The conventional rotary means for triggering the switch, however, can only provide three-directional switch control actions, i.e. levorotary, dextrorotary and pushing control actions. The number of the switch control actions for a user to perform is limited.

SUMMARY OF THE INVENTION

It is an object of the present invention to provide a switching signal input device for use with an electronic apparatus to allow the user to perform four-directional switch control actions.

Another object of the present invention is to provide a four-directional switching signal input device for use with an electronic apparatus, which is simple in configuration.

In accordance with a first aspect of the present invention, there is provided a switching signal input device for use with an electronic apparatus. The switching signal input device comprises a switch part, an operating part and a resilience element. The switch part comprises a circuit board, two forward switches disposed on a first surface of the circuit board, and two lateral switches disposed on a second surface of the circuit board. The operating part comprises an operating rod operated by a user to control the switching signal input device, and a touch portion coupled to the operating rod for touching one switch of the switch part upon the operating rod is operated by the user. The resilience element is used for generating elasticity on first and second planes perpendicular to each other, and comprises a U-shaped portion parallel with the first plane to have the operating part clamped and supported by the resilience element such that the operating rod is operated to perform a levorotary or dextrorotary action on the first plane and a forward or backward shifting action on the second plane.

In an embodiment, the operating part further comprises a trench structure for clamping and supporting the resilience element.

In an embodiment, the touch portion comprises a forward switch touch portion and a lateral switch touch portion. The forward switch touch portion has a hook portion touching the two forward switches when the operating rod is rotated on the first plane. The lateral switch touch portion having two symmetrical slants touching the two lateral switches when the operating rod is moved forwardly or backwardly on the second plane.

In an embodiment, the operating rod, the trench structure and the touch portion of the operating part are integrally formed.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
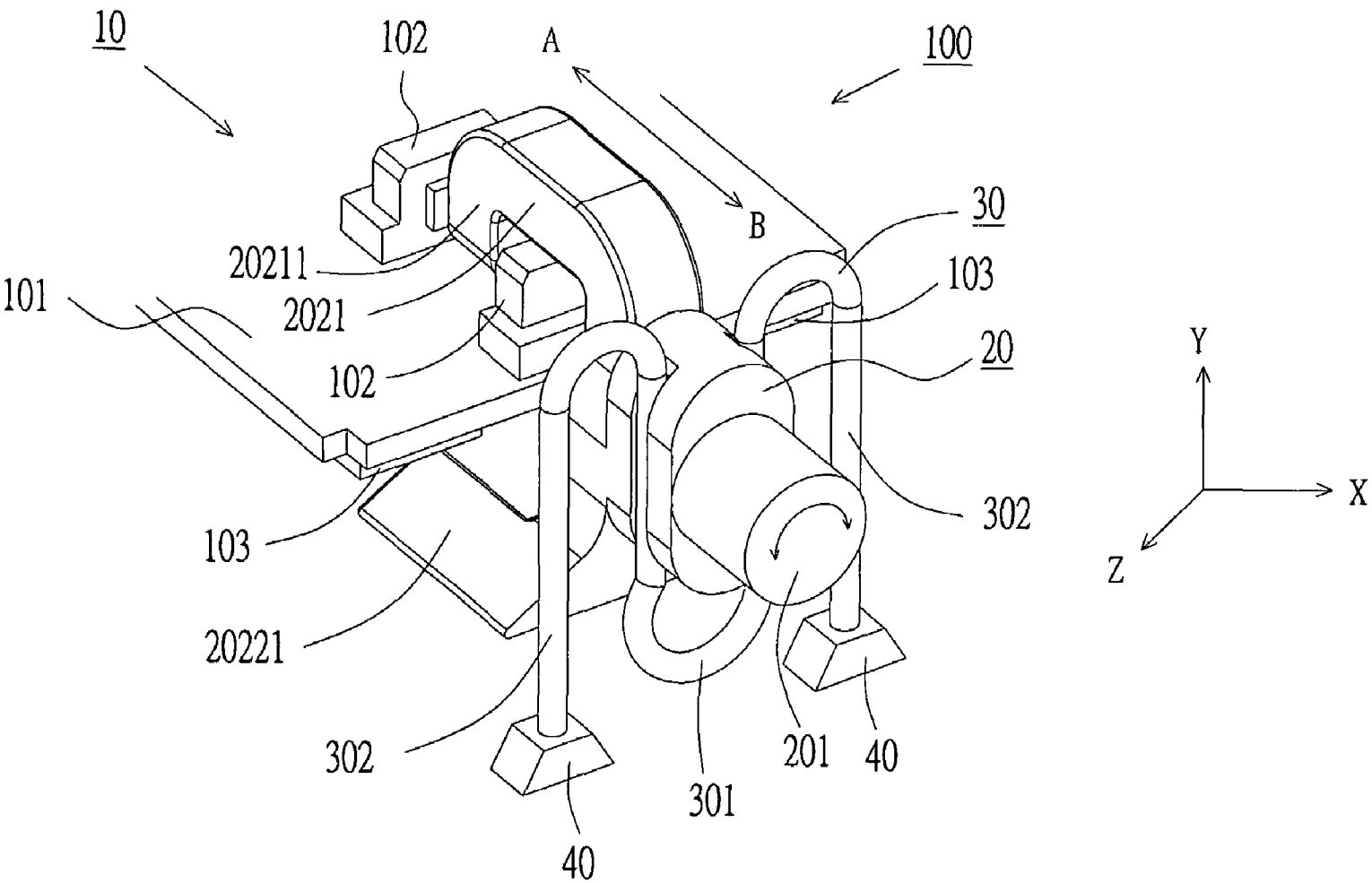
FIG. 1 schematically illustrates a perspective view of a switching signal input device according to a preferred embodiment of the present invention.

Referring to FIG. 1, a perspective view of a switching signal input device according to a preferred embodiment of the present invention is shown. The switching signal input device 100 in FIG. 1 comprises a switch part 10, an operating part 20 and a resilience element 30.

The switch part 10 comprises a circuit board 101, two forward switches 102 and two lateral switches 103. The forward switches 102 are disposed on the top surface of the circuit board 101. Whereas, the lateral switches 103 are disposed on the bottom surface of the circuit board 101.

Figure 2:
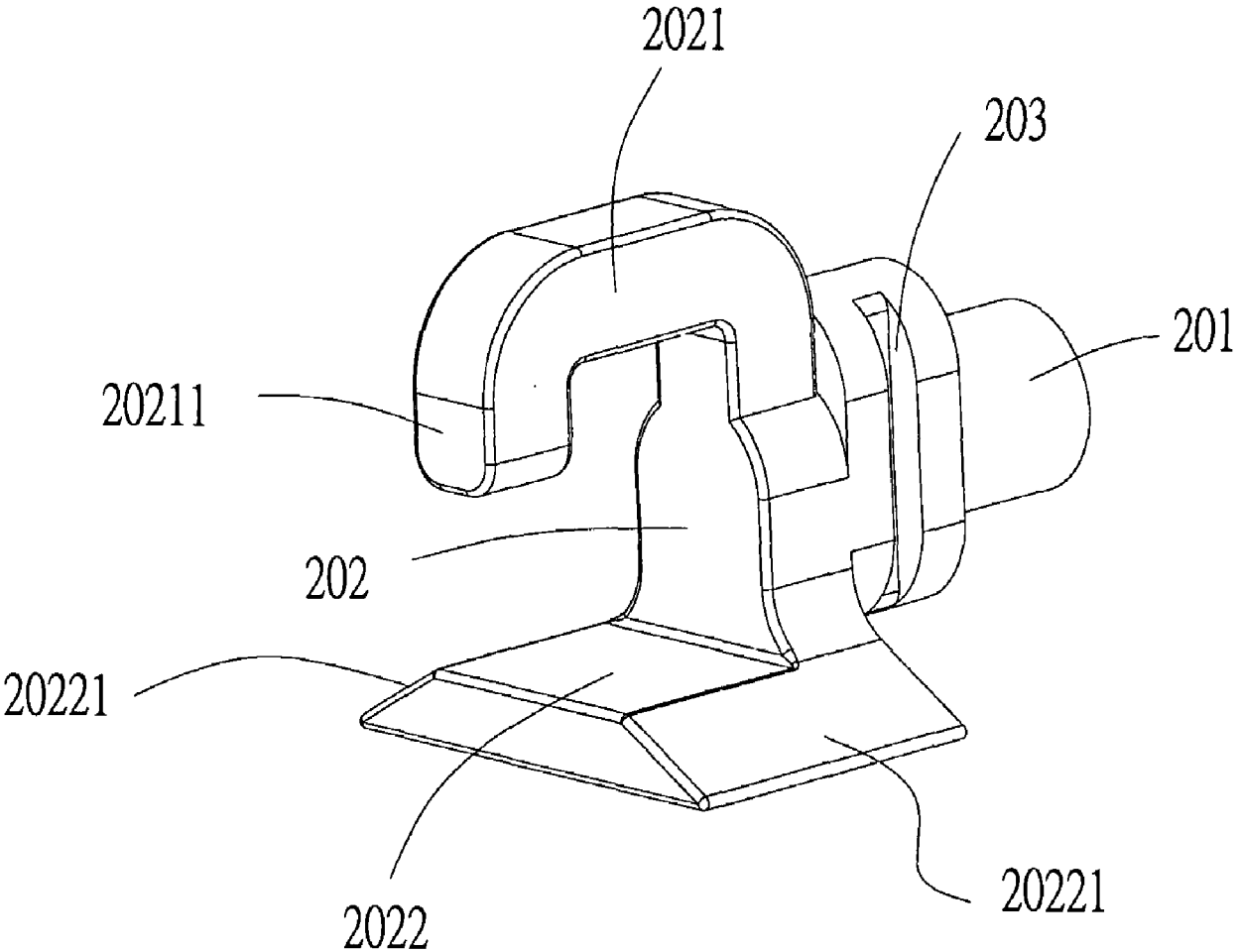
FIG. 2 schematically illustrates the touch potion of the switching signal input in FIG. 1.

Please refer to FIG. 2, which schematically illustrates an exemplary operating part 20 of the present invention. The operating part 20 comprises an operating rod 201, a touch portion 202 and a trench structure 203. In this embodiment, the touch portion 202 comprises a forward switch touch portion 2021 and a lateral switch touch portion 2022. The forward switch touch portion 2021 has a hook portion 20211 selectively touching the forward switches 102. The lateral switch touch portion 2022 has two symmetrical slants 20221 selectively touching the lateral switches 103. Preferably, the components of the operating part 20 are integrally formed into a one-piece part.

Please refer to FIG. 1 again. The resilience element 30 comprises a U-shaped portion 301. Two resilience arms 302 are extended from both ends of the U-shaped portion 301, respectively. By means of these two resilience arms 302, the resilience element 30 is fixed within an electronic apparatus via for example the fixture portions.

Figure 3B:
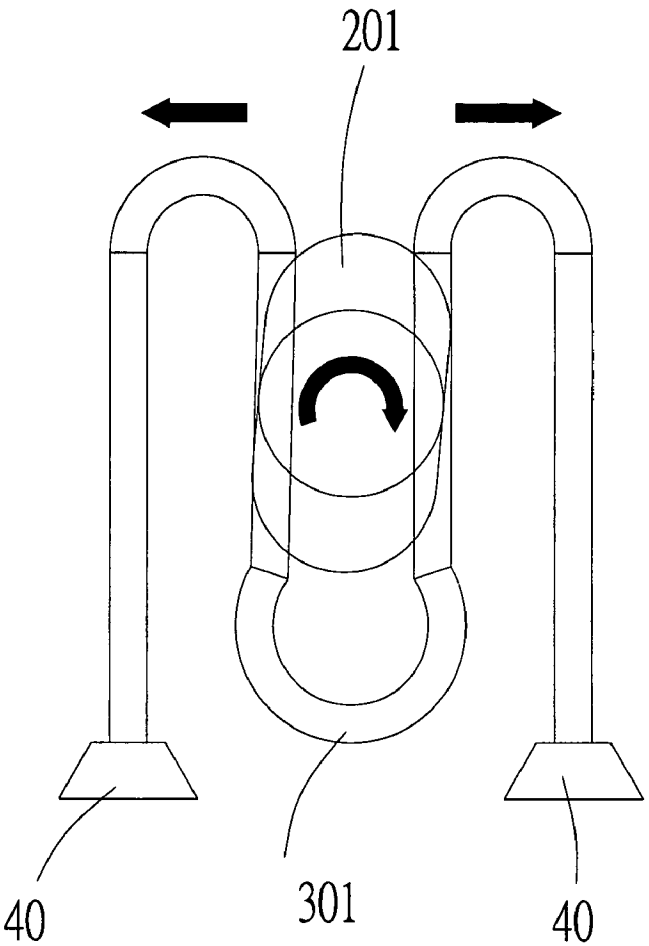
FIG. 3B schematically illustrates deformation of the resilience element upon a dextrorotary operation is performed on the operating rod.
Figure 3A:
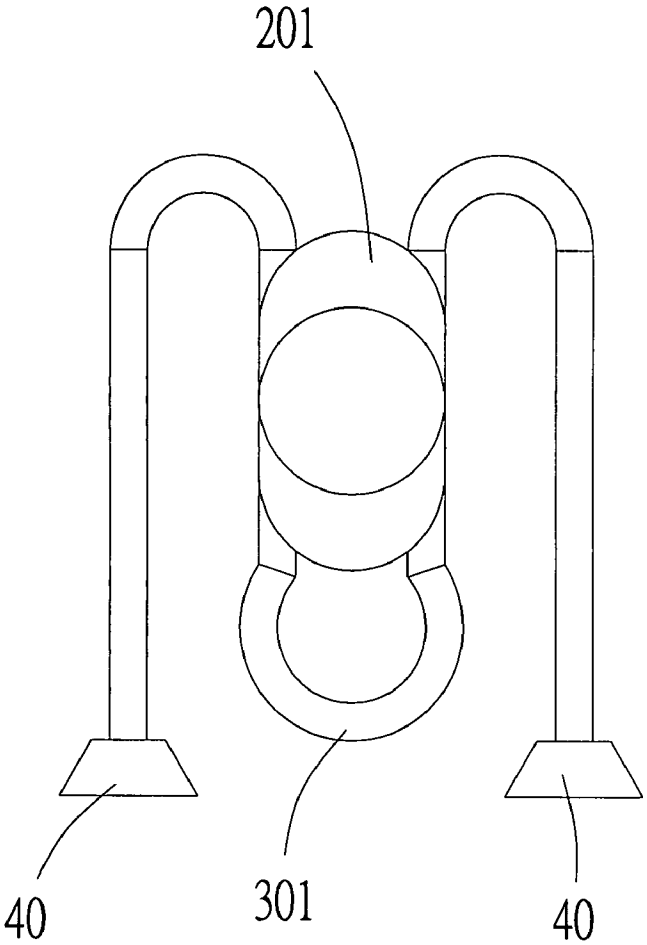
FIG. 3A schematically illustrates the operating rod which has not been operated.

Please refer to FIG. 1, 3A and 3B. The resilience element 30 is disposed on a first plane, i.e. the X-Y plane, and both arms of the U-shaped portion 301 are embedded into the trench structures 203 of the operating part 20 so as to clamp and support the operating part 20 (as shown in FIG. 3A). The operating rod 201 will be rotated on the first plane when a levorotary or dextrorotary operation is performed thereon. For example, as shown in FIG. 3B, when a dextrorotary operation is performed on the operating rod 201, the U-shaped portion 301 of the resilience element 30 will be deformed such that the slants 20221 of the lateral switch touch portion 2022 is shifted to touch the lateral switch 103. Whereas, when the user loosens the operating rod 201, the deformation of the U-shaped portion 301 will be eliminated by the elastic force resulted from the resilience element 30 and thus the operating rod 201 is returned to its original location as shown in FIG. 3A. On the other hand, when the operating rod 201 is pushed to move forwardly in the direction of the arrow A on the second plane perpendicular to the first plane, i.e. the X-Z plane, the U-shaped portion 301 will be deformed such that the hook portion 20211 of the forward switch touch portion 2021 touches the forward switch 102. Once no force is acted on the operating rod 201, the deformation of the U-shaped portion 301 will be eliminated by the elastic force resulted from the resilience element 30 and thus the operating rod 201 is returned to its original location again. Alternatively, the operating rod 201 can be pulled to move in another direction as shown in the arrow B, and thus the U-shaped portion 301 will be deformed such that the hook portion 20211 of the forward switch touch portion 2021 touches another forward switch 102. Once no force is acted on the operating rod 201, the deformation of the U-shaped portion 301 will be eliminated by the elastic force resulted from the resilience element 30 and thus the operating rod 201 is returned to its original location again.

From the above description, it is understood that the switching signal input device of the present invention is capable of performing four-directional switch control in response to the elastic forces generated from the resilience element 30 on two planes perpendicular to each other. When the switching signal input device of the present invention is applied to an electronic apparatus, only one operating rod 201 is sufficient to have the user perform four-directional switch control actions including levorotary, dextrorotary, push and pull control actions. Therefore, the user operation interface is simplified and the appearance of the electronic apparatus is more aesthetically pleasing. Moreover, the constituent components of the overall switching signal input device are simplified and thus the fabricating cost thereof is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A switching signal input device for use with an electronic apparatus, said switching signal input device comprising:

a switch part comprising a circuit board, two forward switches disposed on a first surface of said circuit board, and two lateral switches disposed on a second surface of said circuit board;

an operating part comprising an operating rod operated by a user to control said switching signal input device, and a touch portion coupled to said operating rod for touching one switch of said switch part upon said operating rod is operated by said user; and a resilience element for generating elasticity on first and second planes perpendicular to each other, and comprising a U-shaped portion parallel with said first plane to have said operating part clamped and supported by said resilience element such that said operating rod is operated to perform a levorotary or dextrorotary action on said first plane and a forward or backward shifting action on said second plane.

2. The switching signal input device according to claim 1 wherein said operating part further comprises a trench structure for clamping and supporting said resilience element.

3. The switching signal input device according to claim 2 wherein said touch portion comprises:

a forward switch touch portion having a hook portion touching said two forward switches when said operating rod is rotated on said first plane; and a lateral switch touch portion having two symmetrical slants touching said two lateral switches when said operating rod is moved forwardly or backwardly on said second plane.

4. The switching signal input device according to claim 3 wherein said operating rod, said trench structure and said touch portion of said operating part are integrally formed.

* * * * *